US010233616B2

(12) United States Patent
Friend et al.

(10) Patent No.: US 10,233,616 B2
(45) Date of Patent: Mar. 19, 2019

(54) EXCAVATION UTILIZING DUAL HOPPER SYSTEM

(71) Applicant: Caterpillar Inc., Peoria, IL (US)

(72) Inventors: Paul Friend, Morton, IL (US); Kenneth L. Stratton, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/723,246

(22) Filed: Oct. 3, 2017

(65) Prior Publication Data

US 2018/0179737 A1 Jun. 28, 2018

Related U.S. Application Data

(60) Provisional application No. 62/438,874, filed on Dec. 23, 2016.

(51) Int. Cl.

| | |
|---|---|
| ***E02F 9/26*** | (2006.01) |
| ***B07B 4/02*** | (2006.01) |
| ***G01G 19/22*** | (2006.01) |
| ***G01G 13/24*** | (2006.01) |
| ***G01N 35/04*** | (2006.01) |
| ***E21F 13/04*** | (2006.01) |
| ***E02F 3/84*** | (2006.01) |
| ***E21C 47/04*** | (2006.01) |
| *E02F 3/46* | (2006.01) |
| *E02F 3/30* | (2006.01) |
| *E02F 9/20* | (2006.01) |

(52) U.S. Cl.

CPC ..... *E02F 9/26* (2013.01); *E02F 3/842* (2013.01); *E02F 9/261* (2013.01); *E21C 47/04* (2013.01); *E21F 13/04* (2013.01); *E02F 3/30* (2013.01); *E02F 3/46* (2013.01); *E02F 9/2054* (2013.01)

(58) Field of Classification Search

CPC .. E02F 9/26; E02F 3/434; E02F 3/437; G01G 13/24; G01G 19/22; B07B 4/02; G01N 35/04

See application file for complete search history.

(56) References Cited

U.S. PATENT DOCUMENTS

| | | | | |
|---|---|---|---|---|
| 2,281,816 A * | 5/1942 | Andrews | B07B 4/02 209/474 |
| 3,237,785 A * | 3/1966 | Holmes | G01G 19/22 414/21 |
| 3,979,731 A | 9/1976 | Naplatanov et al. | |
| 4,103,972 A | 8/1978 | Kochanowsky | |
| 5,864,060 A | 1/1999 | Henderson et al. | |
| 6,108,949 A * | 8/2000 | Singh | E02F 3/437 37/195 |

(Continued)

*Primary Examiner* — Yuri Kan

(74) *Attorney, Agent, or Firm* — Leydig, Voit & Mayer, LTD.

(57) ABSTRACT

A guidance system and method for guiding excavation at an excavation site utilizes an excavating machine and an in-pit crusher and conveyer (IPCC) having a first hopper and a second hopper for receiving material. The guidance system can receive first hopper data associated with the first hopper and second hopper data associated with the second hopper and can process the first hopper data and second hopper data to determine a selected hopper for dispensing material. In an aspect, the guidance system can generate a guidance indication to display to the operator of the excavating machine that indicates the selected hopper.

20 Claims, 5 Drawing Sheets

(56) References Cited

U.S. PATENT DOCUMENTS

| | | | | |
|---|---|---|---|---|
| 6,167,336 | A * | 12/2000 | Singh | E02F 3/434 172/2 |
| 2012/0181093 | A1* | 7/2012 | Fehr | G01G 11/086 177/103 |
| 2014/0079591 | A1* | 3/2014 | Toyoshima | G01N 35/04 422/52 |

* cited by examiner

EXCAVATION UTILIZING DUAL HOPPER SYSTEM

TECHNICAL FIELD

The present disclosure relates generally to excavation of material from an excavation site by the cooperative interaction between an excavating machine and an in-pit crusher and conveyer system and, more particularly, to excavation with a dual hopper in-pit crusher and conveyer system.

BACKGROUND

Excavating material such as coal, ore, or other minerals from an excavation site, such as an open pit mine, may be accomplished using an excavating machine such as a rope shovel equipped with a digging tool to physically remove material from the ground and to dispense the material to a hauling machine such as a dump truck. The hauling machine transports the material from the excavation site while the excavating machine remains in place to continue excavating material. Therefore, several hauling machines may be required to keep pace with single excavating machine and maintain efficiency of the operation. More recently, in-pit crushing and conveying ("IPCC") systems have been proposed in which the excavating machine dispenses material into a processing unit referred to as an in-pit crusher that has a funnel-like hopper to receive the dispensed material and a local crushing or grinding unit to pulverize or breakup the material for easier handling. The IPCC is operatively associated with a conveyer that transports the processed material away from the excavation site to a common hauling point. Benefits of the IPCC process include a reduction in the required number of hauling machines and/or the travel distance that the hauling machines must cover, which may be especially advantageous if the hauling machines are otherwise required to travel long, uphill distances to exit the excavation site.

One example of excavating with an IPCC is disclosed in U.S. Pat. No. 8,768,579 ("the '579 patent"), which describes an arrangement of a rope shovel operating to dig and dispense material to a nearby IPCC unit which processes the material for transportation on a conveyer away from the excavation site. To facilitate swinging the digging tool of the rope shovel over the hopper on the IPCC, the '579 patent in particular describes a system of position sensors and electronic controllers configured to calculate the ideal path between the rope shovel and the hopper. The system outputs the results as feedback to assist the operator of the rope shovel. The present disclosure is similarly directed to improving an excavation operation utilizing an excavating machine in cooperation with an IPCC configured with at least a first hopper and a second hopper.

SUMMARY

The disclosure describes, in one aspect, an excavating machine for excavation at an excavation site that is configured to operate in conjunction with a first hopper and a second hopper. The excavating machine includes a digging tool for excavating and dispensing material into the first or second hoppers. The excavating machine also includes a machine receiver for receiving first hopper data associated with the first hopper and second hopper data associated with the second hopper. To determine a selected hopper from between the first hopper and the second hopper, the excavating machine includes a guidance system that is in communication with the machine receiver and that is configured to process the first hopper data and the second hopper data for making the selection.

In another aspect, the disclosure describes a method of assisting excavation at an excavation site utilizing a first hopper and a second hopper at an excavation site. According to the method, first hopper data associated with the first hopper and second hopper data associated with the second hopper are received and compared to determine a selected hopper from the first hopper and the second hopper for depositing excavated material. The method generates a guidance indication reflecting the selected hopper and can display the guidance indication to an operator of an excavating machine operating in cooperation with the first hopper and the second hopper to assist in excavation.

In yet another aspect, the disclosure describes a guidance system for assisting excavation at an excavation site utilizing a first hopper and a second hopper. The guidance system works in cooperation with a machine controller operatively associated with an excavating machine and communicating with a machine receiver disposed on the excavating machine. The first hopper and the second hopper can include a first hopper transmitter operatively associated with a first hopper that transmits first hopper data associated with the first hopper and a second hopper transmitter operatively associated with the second hopper that communicates second hopper data associated with the second hopper. The guidance system is configured to determine a selected hopper for dispensing material into based on comparison of the first hopper data and the second hopper data.

DETAILED DESCRIPTION

Figure 1:
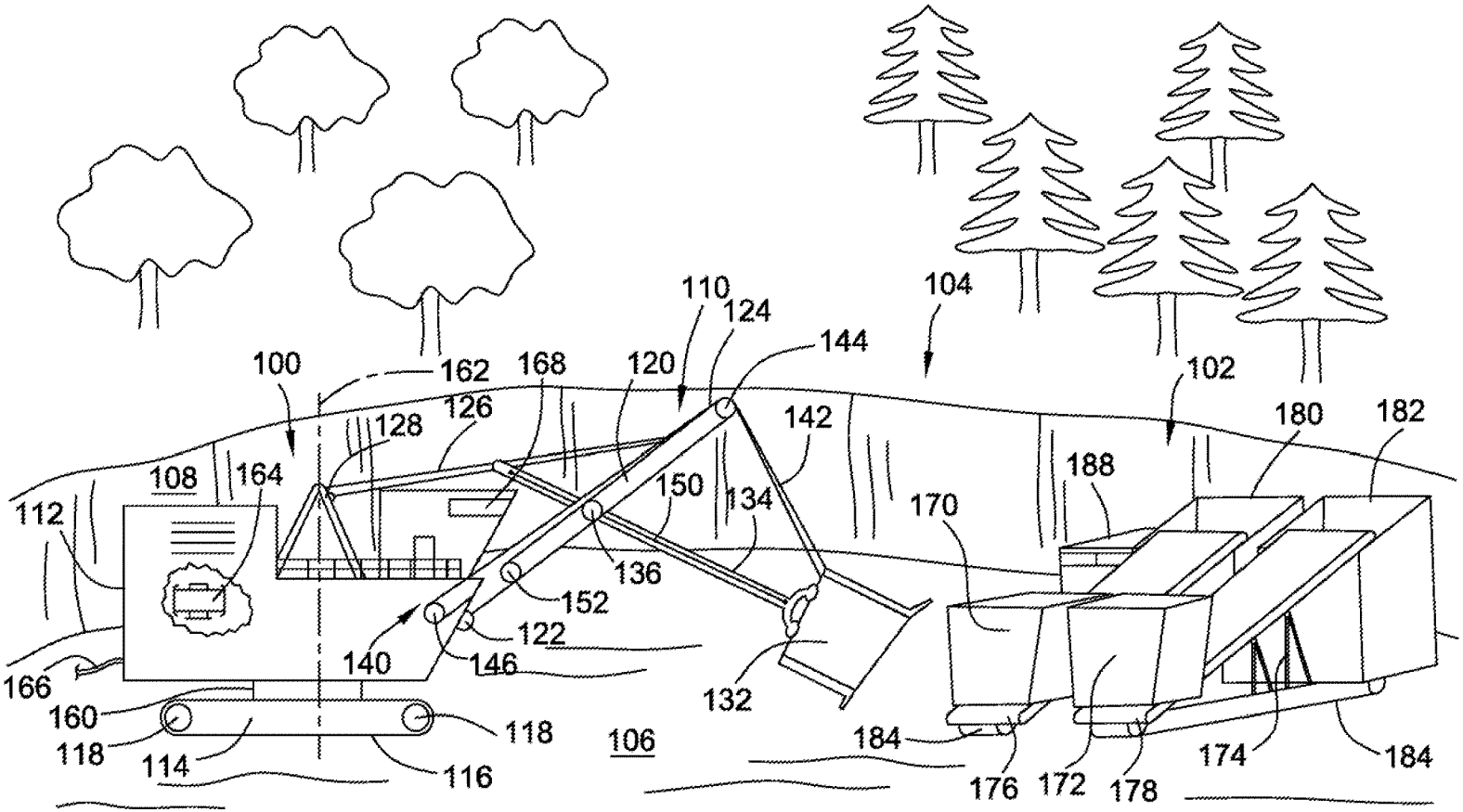
FIG. 1 is a perspective view of an excavation operation at an excavation site utilizing an excavating machine in conjunction with an IPCC unit configured with a first hopper and a second hopper.

Now referring to the figures, wherein like reference numbers refer to like elements, there is illustrated in FIG. 1 a excavating machine 100 operating in cooperation with a in-pit crusher and conveyer ("IPCC") system 102 to excavate material from an excavation site 104. An excavation site 104 in accordance with the present disclosure may be a large scale, open cast or open-pit mine in which overburden is removed or stripped from the surface of the ground by the excavating machine 100 to access the material of interest, which may be coal, ore, or minerals. Excavation results in the planar or horizontal pit floor 106 being continuously lowered while the excavation site 104 is expanded by operation of the excavating machine 100 to remove material from a vertical bank or pit wall 108 that rises from the pit floor 106. In addition to mining, the excavation site 104 may be intended to create canals, reservoirs, or other large scale civil engineering projects.

For excavation on the scale of the present disclosure, the excavating machine 100 may be a mining shovel such as a rope shovel or power shovel that removes material from the excavation site 104 by digging into the pit wall 108 to loosen and remove material from the vertical bank. To dig or crowd into the pit wall 108, the excavating machine 100 can include a digging tool 110 that is pivotally and slidably supported on an upper structure 112 that in turn is supported on and carried by an undercarriage 114. To mobilize the excavating machine 100 and propel it about the excavation site 104, the undercarriage 114 can include traction devices such as continuous tracks 116 that are disposed on each side of the excavating machine 100. The continuous tracks 116 form a closed loop or belt disposed around one or more drive wheels or drive sprockets 118 that are rotatably attached to the undercarriage 114 at fixed locations. Rotation of the drive sprockets 118 cause the continuous tracks 116 to translate with respect to the undercarriage 114 thereby propelling the excavating machine 100 over the pit floor 106 in the forward or reverse directions, or they can turn the excavating machine 100 toward the sides. In other embodiments, however, other traction devices can be utilized to propel the excavating machine 100 about the excavation site 104 such as rotating wheels. Furthermore, in addition to the illustrated rope shovel, other examples of mobile excavating machines 100 include draglines, excavators, wheel or track loaders, hoes and the like. In addition, the excavating machine 100 can be stationary in configuration by omission of the continuous tracks 116.

The digging tool 110 can include a boom 120, which may be an elongated, beam-like structure pivotally connected at its proximate lower end 122 to the upper structure 112 and that extends upwardly to a distal upper end 124. The boom 120 may project forward of the excavating machine 100 by extending at an angle of, for example, 60° with respect to the upper structure 112. To support the boom 120 at its upright, angled orientation, one or more suspension ropes 126 can be attached proximate the distal upper end 124 and extend down to an A-frame shaped backstay 128 disposed on the upper structure 112. To penetrate into and remove material from the vertical pit wall 108, the boom 120 can support a dipper assembly 130 that includes a bucket-like dipper 132 disposed at the distal end of an elongated dipper arm 134. The dipper arm 134 is pivotally supported and can slide with respect to the upright boom 120 by operation of a saddle block 136 that is disposed approximately midway between the proximate lower end 122 and the distal upper end 124. During a digging operation, the dipper assembly 130 is swung upwardly with respect to the pit wall 108 while being projected or forced forwardly into the pit wall 108 so that material is dislodged and collected into the dipper 132. To enable the dipper assembly 130 to translate with respect to the boom 120, the saddle block 136 can be configured as a sleeve or cradle that supports and interacts with the dipper arm 134 via bearings, rollers, or the like. The process of extending and penetrating the dipper assembly 130 into the pit wall 108 to remove material may be referred to as crowding. To dispense material from the dipper assembly 130, the bottom or floor of the bucket-like dipper 130 can be released allowing the material to fall out of the dipper 130.

To cause the relative motion between the dipper assembly 130 and the boom 120, the excavating machine 100 can include a hoist system 140 disposed on the upper structure 112 that includes various motors, actuators, and rigging for operation. For example, to hoist or lower the dipper 132 in the vertical direction, the hoist system 140 can include hoist cables or hoist ropes 142 that are attached to the rear of the dipper 132 and that extend upwardly around a sheave 144 or pulley disposed at the distal upper end 124 of the boom 120. The hoist ropes 142 partially wrap around the sheave 144 to reverse direction and extend back downwards generally parallel to the boom 120 to wrap around a hoist wench 146 disposed in the upper structure 112. The hoist wench 146 may be operatively coupled to a motor to selectively rotate to wind in or pay out the hoist ropes 142. Winding in the hoist ropes 142 can pivot the dipper assembly 130 upwardly with respect to the boom 120 while paying out the hoist ropes 142 can lower the dipper assembly 130 with respect to the boom 120. In addition, the dipper assembly 130 can be operatively associated with one or more crowd ropes 150 that are attached proximate to the respective ends of the dipper arm 134 and that wrap around the saddle block 136 to extend down to a crowd wench 152 rotatably disposed on the boom 120. The crowd wench 152 can rotate to pay out or take in the crowd ropes 150 in a manner that causes the dipper arm 134 to slidably translate with respect to the boom 120 by operation of the saddle block 136. Sequential action of the hoisting and crowding motions with respect to the pit wall 108 crowds the dipper assembly 130 into the pit wall 108 dislodging material and filling the dipper 132. While the foregoing description of the digging tool 110 relates to a rope-operated configuration, it will be appreciated that in other embodiments, the digging tool 110 may be operated by other methods or processes.

To move the dislodged material away from the pit wall 108, the upper structure 112 can swing or rotate with respect to the undercarriage 114. For example, the upper structure 112 and the undercarriage 114 may be operatively connected through a rotatable turn table or swing platform 160 that can swing the upper structure 112 about a swing axis 162 that extends vertically through the excavating machine 100. To provide power for the hoist system 140, hoist and crowd wenches 146, 152, and the continuous tracks 116, the excavating machine 100 includes an electrical system 164 that receives three-phase electrical power through a trail cable 166 from an off-board electrical source and that distributes power to the various components. In alternative embodiments, however, the excavating machine may include an on-board prime mover such as an internal combustion engine that combusts hydrocarbon-based fuel to generate mechanical power. To accommodate an operator and the various controls, gauges, and interfaces for operating the excavating machine 100, an operator's station 168 can be disposed on the upper structure 112 in a location that provides a view towards the digging tool 110.

The in-pit crusher and conveyer ("IPCC") system 102 operates in cooperation with the excavating machine 100 to transfer the material removed from the pit wall 108. In the illustrated embodiment, the IPCC 102 can be a dual hopper configuration including a first hopper 170 and a second hopper 172 that are supported on an IPCC frame 174. The first and second hoppers 170, 172 can be configured as funnel-like structures that receive material through their opened top ends and tapper inwardly towards their bottom ends to direct the material to first conveyer 176 disposed under the first hopper 170 and a second conveyer 178 disposed under the second hopper 172 respectively. The first and second conveyers 176, 178 can be configured as flexible, closed belts made of rubber or the like that extend around and are supported by conveyer pulleys. One or more of the conveyer pulleys can be made to rotate causing the belt of the conveyers 176, 178 to translate with respect to the bottom of the first and second hoppers 170, 172.

To pulverize the deposited material, the first and second conveyers 176, 178 can extend upwardly to and terminate at the opening of a first material processing device 180 and a second material processing device 182 respectively. The conveyers 176, 178 thereby drop the material into respective material processing devices 180, 182. The first and second material processing devices 180, 182 can be configured as grinders that breakup the material into finer grades of particulate matter or aggregate for easier handling and transfer. In particular, the first and second material processing devices 180, 182 can be upright structures that include internal gears, teeth or blades that interact to shred or masticate the deposited material that is then dispensed from the lower end. The first and second material processing devices 180, 182 can further include vibrators and the like to assist in processing the material. The IPCC 102 can be operatively associated with a secondary conveyer system, or in other embodiments with hauling machines, that transport process material away from the open pit of the excavation site 104 to another location where the processed material can be further refined, separated, and/or hauled away.

To enable the IPCC 102 to independently move about the excavation site 104, in an embodiment, the IPCC frame 174 can be supported on another plurality of continuous tracks 184 that contact and can be made to translate with respect to the pit floor 106. Hence, as the pit wall 108 shifts location, the excavating machine 100 and the mobile IPCC 102 can be moved to continue the excavation. However, in other embodiments, the IPCC 102 may be stationary and require another device to move it about the excavation site 104. To accommodate an operator and controls for directing operation of the IPCC 102, an operator's station 188 can be disposed on the side of the IPCC frame 174 above the continuous tracks 184. In the present embodiment, assuming the scale of the excavating machine 100 and the excavation site 104, it can be appreciated that the IPCC 102 can be several meters high.

Figure 2:
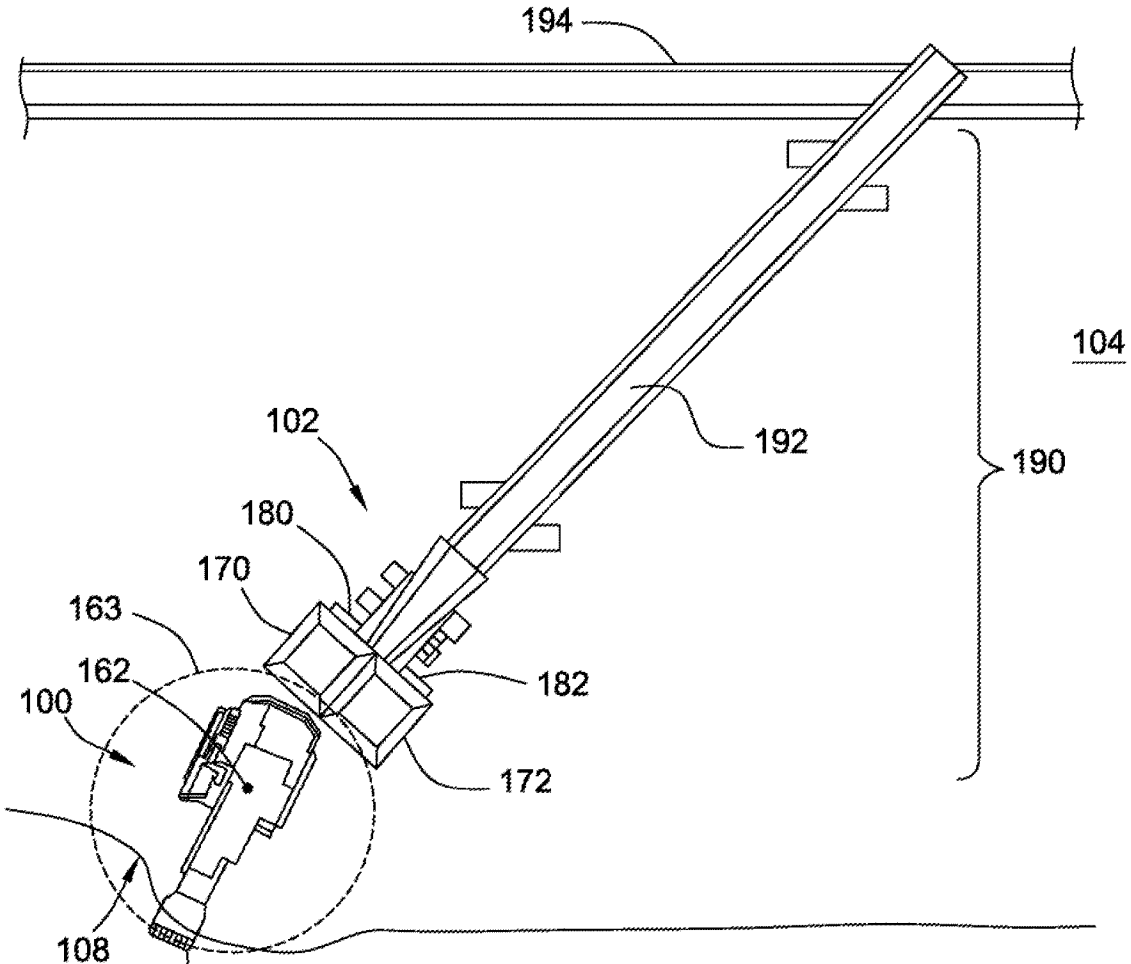
FIG. 2 is a top plan schematic representation of the excavating machine operating in conjunction with the IPCC unit to transport material from the excavation site by an interacting series of conveyers.

Referring to FIG. 2, the excavation process using the excavating machine 100 in cooperation with the IPCC 102 can be understood. The excavating machine 100 is oriented toward the pit wall 108 extending along the excavation site 104 and the IPCC 102 can be positioned behind the excavating machine 100, preferably within a swing radius 163 defined by the distance that the digging tool 110 extends outwardly with respect to the swing radius 163. Accordingly, the first and second hoppers 170, 172 are within reach of the excavating machine 100 as it rotates with respect to the swing axis 162 so that the excavating machine 100 can remain stationary during each digging cycle. In the illustrated embodiment, the dual-hopper IPCC 102 can be configured with the first hopper 170 disposed in a side-by-side relation with the second hopper 172. The first and second hoppers 170, 172 and their respectively associated first and second material processing devices 180, 182 can discharge the processed material through a common outlet. However, in other embodiments, other configurations for the dual-hopper IPCC 102 are possible such as a T-configuration with the first and second hopper 170, 172 spaced apart and discharging to a common discharge outlet or a side-by-side configuration of the first and second hoppers 170, 172 each discharging to separate discharge outlets. Furthermore, the disclosure contemplates distinct first and second IPCC units each having a single hopper arranged together, for example, on either side of the excavating machine 100, and operating in parallel with each other. Further embodiments of the disclosure can include three or more hoppers arranged radially about the swing axis of the excavating machine 100 to receive material.

To excavate material, the digging tool 110 is crowded into the pit wall 108 in a manner that removes material from the pit wall 108. The excavating machine 100 is swung around its swing axis 162 away from the pit wall 108 toward the IPCC 102 located within the swing radius 163. The digging tool 110 can be positioned over or above either the first hopper 170 or the second hopper 172 and the material dispensed or released from the excavating machine 100. The IPCC 102 then processes the material as described above and can discharge the processed material to a secondary conveyer system 190. In the illustrated embodiment, the secondary conveyer system 190 can include an intermediate conveyer 192 and a main conveyer 194 that are disposed in the excavation site 104. The main conveyer 194 can be generally fixed in location while the intermediate conveyer 192 is relatively more mobile so that it can be extended and adjusted to follow proximately with the excavating machine 100 and the IPCC 102. The intermediate and main conveyers 192, 194 can be of a closed loop construction and include closed belts, slide plates, or trays, and can be straight in alignment or can include various suitable bends or turns. In addition, the secondary conveyer system 190 can be configured to elevate the processed material from the pit floor 106 out of the excavation site 104 to a location where the material may be more accessible. In another aspect of the disclosure, the IPCC may dispense processed material dispensed into the first or second hoppers 170, 172 into hauling machines such as dump trucks for transporting the processed material from the excavation site 104.

While the IPCC 102 is processing the dispensed material and discharging it to the secondary conveyer system 190 or to the hauling machines, the excavating machine 100 can swing about the swing axis 162 back to engage the pit wall 108 with the digging tool 110 again. Hence, the excavating machine 100, the IPCC 102, and the secondary conveyer system 190 operate concurrently to continuously remove and process material from the excavation site 104.

Figure 3:
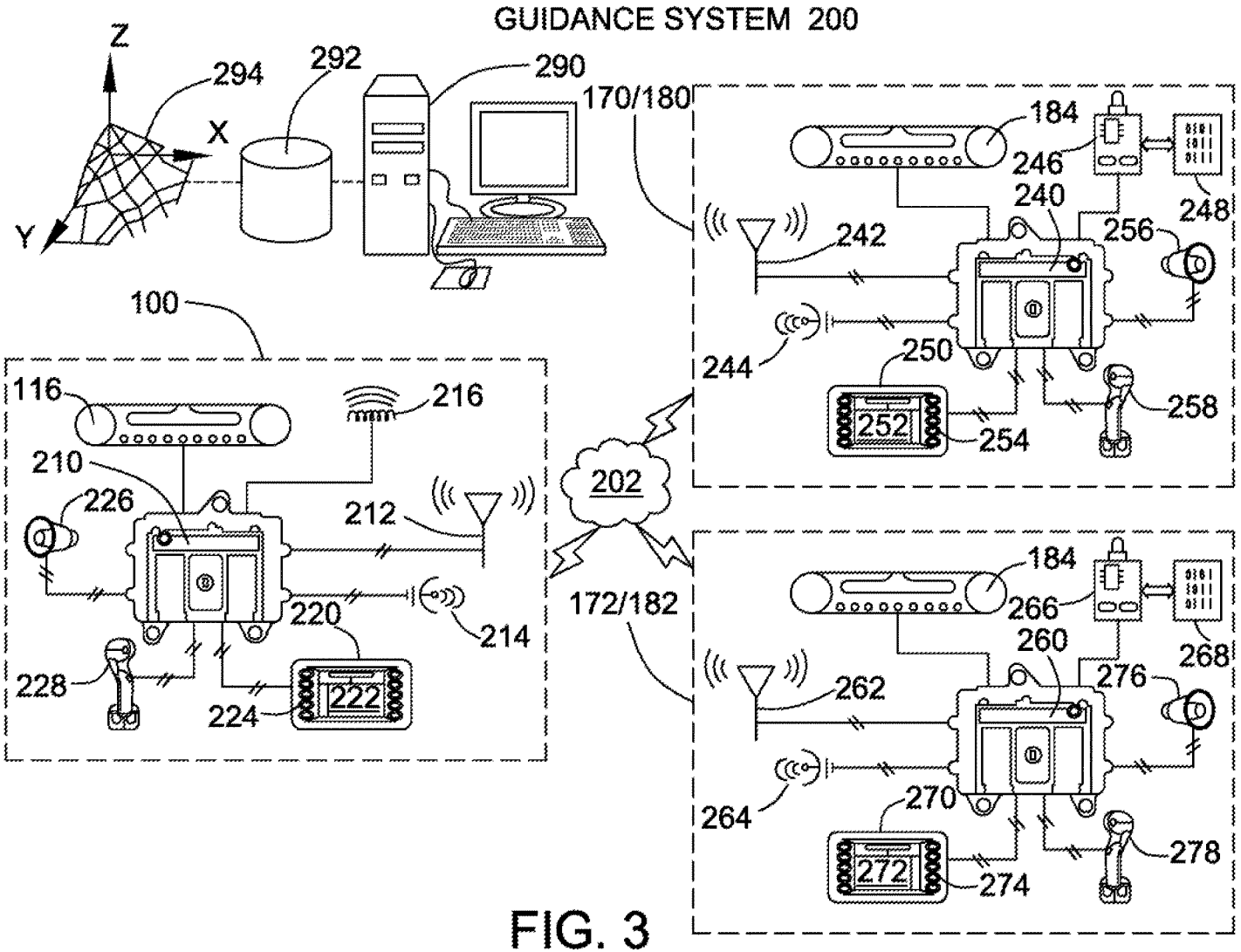
FIG. 3 is a schematic representation of the sensors, communication devices, and logical devices that are operatively associated with the excavating machine and the IPCC to facilitate excavation.

In the present embodiment where the dual-hopper IPCC 102 includes a first hopper 170 and a second hopper 172, operation of the excavating machine 100 and the IPCC 102 can be synchronized for improving the excavation process. Referring to FIG. 3, to synchronize the excavating machine 100 and IPCC 102, the excavating machine 100 and dual-hopper IPCC 102 can be operatively associated with a computerized or electronic guidance system 200 that is configured to coordinate, control, and guide cooperative or simultaneous operation of the two devices. In various embodiments, the guidance system 200 may be intended to provide operational guidance to an operator of the excavating machine 100, or may be intended to automatically guide and direct operation of the excavating machine 100 without operator intervention. The guidance system 200 can be physically embodied as a communications network or computerized excavation network 202 that interconnects and establishes communication to exchange data and information between the excavating machine 100, the IPCC 102, and other systems and devices about the excavation site 104; although in specific embodiments, the guidance system 200 may reside with, or be more particularly associated with, a specific component.

For example, to establish interaction between the excavating machine 100 and the excavation network 202 in a manner that maintains the guidance system 200 for execution, the excavating machine 100 can include an electronically actuated machine controller 210 onboard that is able to execute and process various software instructions, programs, functions, steps, routines, tasks and processes. The machine controller 210 can be embodied as a microprocessor, an application specific integrated circuit ("ASIC"), or other appropriate circuitry and may have computer readable and writable memory or other data storage capabilities. The computer readable and writable readable memory can include any suitable type of electronic memory devices such as random access memory ("RAM"), read only memory ("ROM"), dynamic random access memory ("DRAM"), flash memory and the like. The computer readable and writable memory may store data and applications such as data tables, charts, maps, and the like saved in and executable from the memory or another electronically accessible storage medium to assist in operation of the excavating machine 100. The machine controller 210 may be responsible for controlling operation of other components of the excavating machine or may be integrated with other control devices through, for example, an CAN bus associated with the excavating machine. Although in the schematic representation of FIG. 3, the machine controller 210 is represented as a single, discrete unit, in other embodiments, the machine controller 210 and its functions may be distributed among a plurality of distinct and separate components associated with the excavating machine 100.

To enable the machine controller 210 to send, receive, and process data about the excavation process via the excavation network 202, the machine controller 210 can be operatively associated with any of various sensors, communication devices, and other logical or electronic components. For example, to establish communication with the IPCC 102 and/or the excavation network 202, a mobile machine communications device in the form of a machine receiver/transmitter 212 can be disposed on the excavating machine 100 and is configured to send and receive electronic signals that may be in digital or analog format. The machine receiver/transmitter 212 can include an antenna to receive and emit signals such as radio frequency waves. In other embodiments, the machine receiver/transmitter 212 can communicate through other wireless technologies such as infrared, Bluetooth, optical recognition, and the like. Furthermore, in other embodiments, the machine receiver/transmitter 212 can be configured for wired communication by sending and receiving electrical, optical, or other forms of signals over communications wires or busses. While the present embodiment of the machine receiver/transmitter 212 can send and receive signals, in other embodiments the machine receiver/transmitter 212 may be limited to either receiving or transmitting, and the term "receiver/transmitter" should be interpreted in both the conjunction and disjunctive sense. The machine receiver/transmitter 212 and the machine controller 210 can include or be associated with circuitry or like to convert or interpret the sent or received signals into data and information that can be electronically or digitally processed to facilitate operation of the excavating machine 100.

To provide information about the location or position of the excavating machine 100 with respect to the excavation site 104, the machine controller 210 can also be operatively associated with a positioning device or machine position sensor 214. The machine position sensor 214 can recognize or determine the relative position of the excavating machine 100 with respect to other units disposed about the excavation site and can relay the machine position data to the guidance system 200 via the machine controller 210. For example, the machine position sensor 214 can operate on a Global Navigation Satellite System ("GNSS") whereby the machine position data associated with the excavating machine 100 is triangulated from received satellite signals. However, in other embodiments described in more detail below, the machine position sensor 214 can operate based on other technologies. In an embodiment, the machine position sensor 214 may be associated with a particular part or component of the excavating machine 100 such as, for example, the digging tool 110 to provide precise machine position data with respect to that particular component. In another embodiment, the machine position data can be determined from the general position of the excavating machine 100 at the excavation site and data obtained from kinematic maps describing the precise position of the digging tool 110 at the relevant time. For example, the machine position data may reflect the swing position or swing angle of the digging tool 110 with respect to the swing axis 162 of the excavating machine 100.

In addition to the machine position sensor 214, the excavating machine 100 may be associated with a material sensor 216 disposed on the machine to sense characteristics or properties of the material removed by the digging tool 110. The material sensor may be disposed proximate to the bucket and sense properties such as the weight or quantify of the material removed and receive into the digging tool during a digging event, e.g. a weigh sensor. In another embodiment, the material sensor 216 can sense particular qualities associated with the material such as density, granularity, type, composition or substance, or physical structure or chemical makeup of the material, which may indicate if and how much of the removed material is of the kind desire, e.g., ore or mineral or coal. For example, the material sensor 216 can utilize x-ray diffraction, audio or sonic waves, electromagnetic waves, laser scanning, or the like to sense certain qualities of the material and can the machine controller 210 can analyze the information received by these technologies to make determinations about the quality of the material.

To interface or interact with an operator of the excavating machine 100, the machine controller 210 can be operatively associated with an electronic user interface 220. The electronic user interface 220 may be disposed at an accessible location in the operator's station 168 onboard of the excavating machine 100, although in other embodiments, it may be an off board, handheld device configured to remotely operate the excavating machine 100. The electronic user interface 220 can include various components to interface with the operator such as a display screen 222, which may be a liquid crystal display with touch screen capabilities. The electronic user interface 220 may also include various dials, switches, or buttons 224 through which commands may be entered. To further facilitate communication with the operator, the electronic user interface 220 can be associated with one or more warning indicators or alarms 226, which may be audible or visual in nature.

In an embodiment, to integrate the machine controller 210 with operation of the excavating machine 100, the machine controller 210 can be operatively associated with the components used to physically direct operation of the excavating machine 100. For example, the machine controller 210 can be in communication with one or more input devices 228 such as joysticks, steering wheels, gear selectors, pedals, and the like by which the operator directs movements and operation of the excavating machine 100. Accordingly, the machine controller 210 receives current information indicating the task or operation the machine is being directed to perform. In a further embodiment, the machine controller 210 may also be operatively associated with the continuous tracks 116 or other traction or propulsion devices included with the excavating machine 100.

To enable the IPCC 102 to interact with the guidance system 200 via the excavation network 202, the IPCC 102 can also be equipped with similar electronic and digital onboard components. Furthermore, to utilize the dual-hopper configuration, the electronic components can be specifically associated with the first hopper 170 or the second hopper 172. For example, the first hopper 170 and the first material processing device 180 associated with it can be operatively associated with a first hopper controller 240 that can have a similar electronic architecture as the machine controller 210 and can include circuitry to execute various software instructions, programs, routines, functions, processes and the like. To enable communication with the excavation network 202, the first hopper controller 240 can be operatively associated with a communication device that may also be embodied as a first hopper transmitter/receiver 242 that can send and receive radio frequency or other communication signals. To assess or determine the location of the first hopper 170 with respect to the excavation site 104, particularly with respect to the excavating machine 100 and the second hopper 172, the first hopper controller 240 can communicate with a first hopper location sensor 244. The first hopper location sensor 244 can also operate based on use of Global Navigation Satellite System ("GNSS") or any other suitable positioning technology.

The first hopper controller 240 may be integrated with the other components and systems on the IPCC 102, for example, by including a first hopper status sensor 246 operatively associated with the first hopper 170 and/or the attached first material processing device 180 to monitor the operating conditions of those devices. The first hopper status sensor 246 can monitor parameters, characteristics and settings of the first hopper 170 and the first material processing device 180 to generate and communicate first hopper data 248 associated with operation of the first hopper 17. The first hopper data 248 can be embodied as transmittable digital or analog signals reflecting information regarding the status of the first hopper 170 and/or its associated first material processing device 180. For example, the first hopper data 248 may reflect information such as hopper volume, hopper capacity, hopper processing rate, and hopper configuration data regarding the type or grade of material that can be processed, and similar information. In an embodiment, the first hopper data 248 may include or be combined with the hopper location information determined by the first hopper location sensor 244.

If the IPCC 102 is sufficiently large in scale or size, or its operation is automated, the first hopper controller 240 can interface with an electronic user interface 250 that also includes a display device 252 such as an LCD screen and one or more dials, switches and buttons 254 to interact with the operator. The electronic user interface 250 may also be associated with one or more warning indicators such as an audible or visual alarm 256. If the IPCC 102 is independently mobile, the first hopper controller 240 can communicate with the input device 258 such as a joystick used by the operator to move or steer the IPCC 102 and can communicate with the continuous tracks 184 or other traction devices associated with the IPCC.

The second hopper 172 and the second material processing device 182 can be configured similarly to the first hopper 170 and first material processing device 180 and can be operatively associated with a second hopper controller 260 that can receive and process data and instructions to regulate operation of the second hopper 172 and second material processing device 182. The second hopper controller 260 can be in communication with a communications device such as a second hopper receiver/transmitter 262 that can send and receive signals via the excavation network 202. The second hopper controller 260 can also communicate with a second hopper location sensor 264 that can determine the relative location of the second hopper 172 at the excavation site 104 with respect to the excavating machine 100 and the first hopper 170. To determine the processing status of the second hopper 172 and the second material processing device 182, the second hopper controller 260 is associated with a second hopper status sensor 266 disposed on the second hopper 172 and/or second material processing device 182 that can generate second hopper data 268 reflecting the above identified characteristics and values. Likewise, to interface with an operator, the second hopper controller 260 can be operatively associated with a second electronic user interface 270 including a second display screen 272, switches, dials and buttons 274, and an alarm 276 that are dedicated to the second hopper 172 and second material processing device 182. However, in some embodiments where the first and second hoppers 170, 172 are part of the same IPCC 102, the first and second electronic user interfaces 250, 270 may be a combined unit providing a single point of interaction. Relatedly, where the first and second hoppers 170, 172 are part of distinct and independently movable first and second IPCC units operating in parallel, the second hopper controller 260 can be in communication with an input device 278 controlling the continuous tracks 184 associated with the second IPCC.

In addition to machine controller 210 and the first and second hopper controllers 240, 260, the guidance system 200 can utilize data from other sources integrated with the excavation network 202. For example, an excavation base station 290 may be present at the excavation site 104 where comprehensive excavation site data 292 resides regarding the excavation site 104, such as terrain data, excavation plans, material locations and the like. The excavation site data 292 may stored in an electronically readable format in a database or the like at the excavation base station 290 and can be transmitted and supplemented by data exchanges over the excavation network 202. In an embodiment, the excavation site data 292 can include information from topographic or terrain excavation maps 294 regarding the location, by coordinates or otherwise, of the different types of material present at the excavation site 104. For example, the excavation maps 294 can identify the locations of coal, ore or mineral deposits at the excavation site 104 or can indicate if a certain location consists primarily of overburden. The excavation site data 292 may include information about the quality of the material, such as ratios, grades, material density, or compositions, including chemical and soil data. The excavation site data 292 may reflect the granularity or aggregate size of the material at different locations about the excavation site 104, such as may be obtained from prior blasting of the material. The excavation maps 294 can be three-dimensional to reflect the depth of the different materials at a particular location. Information for the excavation maps 294 can be gathered by pre-excavation scouting and exploration of the excavation site 104.

INDUSTRIAL APPLICABILITY

Figure 4:
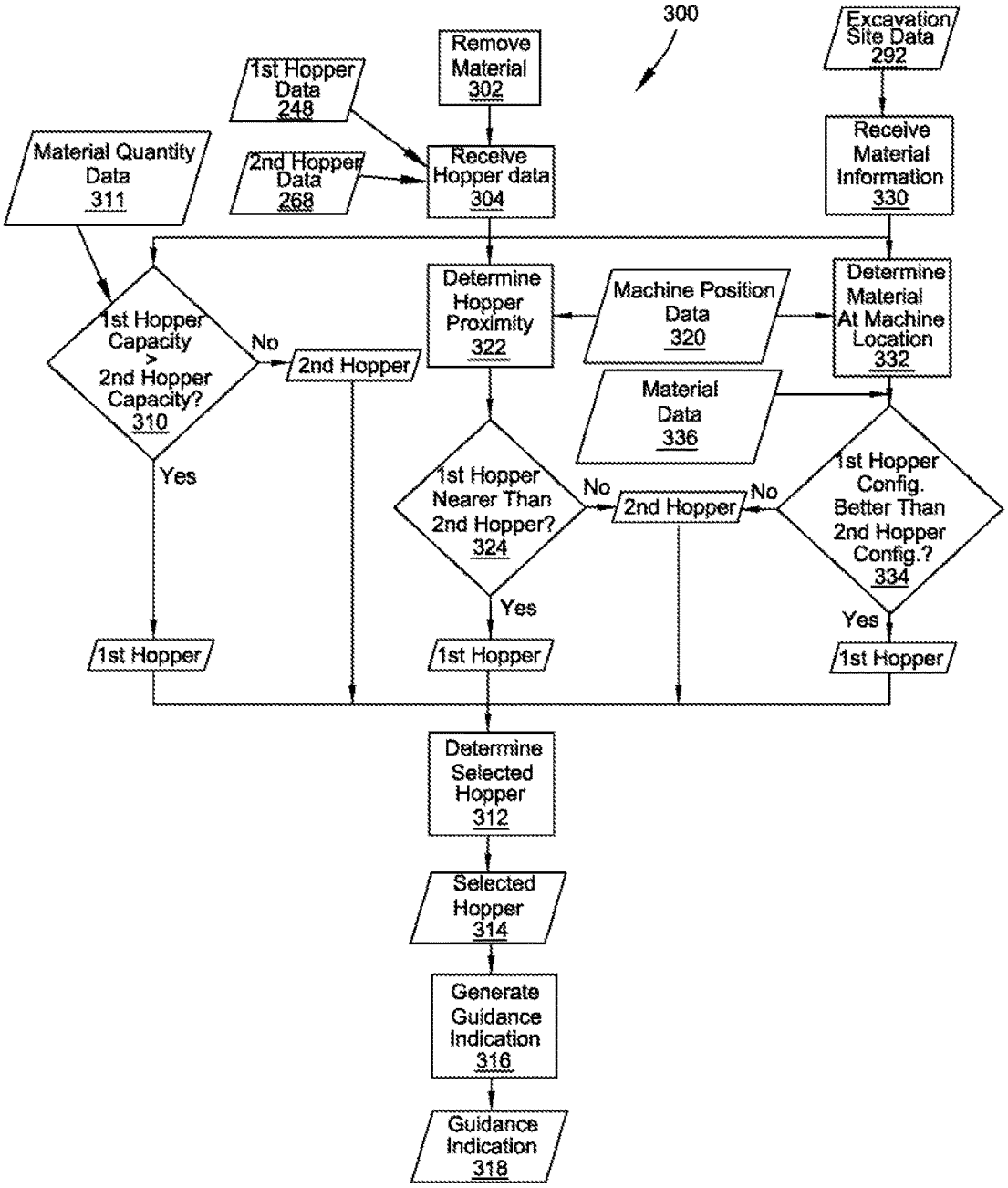
FIG. 4 is a logic diagram or flowchart representing a possible process for assisting the excavation process by determining a selected hopper between the first hopper and the second hopper in which to dispense material.

The foregoing guidance system 200 can assist or guide cooperative interaction between the excavating machine 100 and the dual-hopper IPCC 102 during excavation. The assistance or guidance may be embodied as a guidance indication that can be communicated to the operator of the excavating machine 100 and/or the IPCC 102 and may reflect information such as which of the first or second hoppers 170, 172 the removed material should be dispensed in or where the excavating machine 100 should excavate material from. In other embodiments, the guidance system 200 can automatically control and direct the excavating machine 100 to dispense material into the selected hopper that may process and discharge the material to a secondary conveyer system 290 or, alternatively, hauling machines. For example, referring to FIG. 4, there is illustrated an embodiment of a dispensing process 300 or a series of processes that may be executed by the guidance system 200 for generating guidance regarding the preferred or selected hopper in which to dispense material from the excavating machine 100. The dispensing process 300 can be embodied as software including instructions and commands written in computer-executable programming code. In accordance with the disclosure and with reference to FIGS. 2, 3, and 4, the dispensing process 300 initially begins with a material removal step 302 to dig and remove material from the pit wall 108 with the digging tool 110 of the excavating machine 100. To assess or analyze information regarding the IPCC 102, the dispensing process 300 can receive for processing the first hopper data 248 and the second hopper data 268 in a receiving hopper data step 304. In a specific embodiment, during the receiving hopper data step 304, the guidance system 200 can receive the first hopper data 248 and the second hopper data 268 transmitted by the first and second hopper receiver/transmitters 242, 262 via the excavation network 202.

In an embodiment, the dispensing process 300 can select the first or second hopper 170, 172 based on the capacity or the capability of the first and second hoppers 170, 172 to receive material. For example, the first hopper data 248 and the second hopper data 268 may reflect hopper capacity data regarding capacity of the first and second hoppers 170, 172 at the relevant time to process additional material. The hopper capacity data may include hopper volume data regarding the volume of material present and being processed in the first and second hopper 170, 172 or throughput or rate data regarding the speed at which the first or second hoppers 170, 172 are capable of processing and discharging the material. For example, if the first hopper 170 recently received and is processing material from the excavating machine 100, it may not be ready to receive additional material.

Accordingly, the dispensing process 300 in a capacity comparison step 310 can process or compare the hopper capacity data associated with the first hopper 170 and the second hopper 172. The capacity comparison step 310 determines which of the first and second hoppers 170, 172 has capacity at the relevant time, and the dispensing process 300 proceeds to a hopper selection step 312 in which the dispensing process 300 determines a selected hopper 314 from the processed first and second hopper data 248, 268. The capacity comparison step 310 can account for additional factors such as the capacity of or volume of material in the digging tool 110, or time since material was last dispensed to each of the first and second hoppers 170, 172. In an embodiment, the digging tool 110 may be configured with a material sensor 216 to determine information like the weight or volume of material to dispense to the hoppers or to discern more qualitative data such as composition, consistency, or grade of material. The capacity comparison step 310 can receive material quantity data 311 obtained from the material sensor 216 regarding the quantity, volume, mass, weight, etc. of the material removed and contained in the digging tool 110 to assist in comparing the hopper capacity. In accordance with being a guidance system 200, the dispensing process 300 in a subsequent indication generation step 316 can generate a guidance indication 318 to communicate to the operator of the excavating machine 100. The guidance indication 318 is indicative of which of the first hopper 170 and the second hopper 172 are the selected hopper 314 as determined by the hopper selection step 312. The guidance indication 318 can be displayed on display screen 222 included with the electronic user interface 220 disposed on the excavating machine 100, and may appear as a red or green arrow directing the operator to swing the excavating machine 100 toward the selected hopper 314. As indicated above, in other embodiments, the guidance system 200 can automatically direct the excavating machine 100 to dispense material into the selected hopper 314.

In another embodiment, the guidance system 200 and the dispensing process 300 can select one of the first and second hoppers 170, 172 based on proximity. For example, the first hopper data 248 and the second hopper data 268 received by the receive hopper data step 304 can reflect hopper location data of the respective first and second hoppers 170, 172. As stated above, the hopper location data can be determined by the first hopper location sensor 244 on the first hopper 170 and a second hopper location sensor 264 on the second hopper 172, which may triangulate their respective locations using satellite signals. To compare relative distances, the guidance system 200 can receive machine position data 320 from the machine position sensor 214 that also can be determined using satellite signals. In a proximity determination step 322, which can include a comparison sub-step 324, the dispensing process 300 can compare the hopper location data regarding the first and second hoppers 170, 172 and the machine position data 320 to determine which of the first and second hoppers 170, 172 the excavating machine 100 is nearest. In the embodiments where the machine position data 320 is specific to the digging tool 110, the proximity determination step 322 can reflect the shortest swing angle to the nearest hopper thereby minimizing the distance the excavating machine 100 must swing to dispense material. The dispensing process 300 proceeds to the hopper selection step 312 to determine the selected hopper 314 based, in this embodiment, on the proximity determination step 322. The dispensing process 300 can also conduct the indication generation step 316 to generate a responsive guidance indication 318.

In an alternative embodiment, rather than using satellite signals, the guidance system 200 can rely on other positioning methods or range determining methods for determining the selected hopper 314 from the nearer of the first hopper 170 and the second hopper 172. For example, the machine receiver/transmitter 212 disposed on the excavating machine 100 can be configured as an optical sensor sensitive to visual or optical data such as laser light, infrared light, or image data. In an embodiment similar to LIDAR, the machine receiver/transmitter 212 may direct a laser beam toward the first and second hoppers 170, 172, which is reflected and received by the machine receiver/transmitter 212. Logic associated with the machine controller 210 can process this visual form of first and second hopper data 248, 268 to determine which of the first and second hoppers 170, 172 is nearest for dispensing material. In another embodiment, the first and second hopper receiver/transmitters 242, 262 can emit respective first and second hopper data 248, 268 in the form of infrared light that can be received by the machine receiver/transmitter 212 and processed accordingly by the machine controller 210. Other embodiments of a positioning system include ground-based positioning systems such as pseudolites, visual perception systems such as LIDAR, stereo, camera systems, and Radar, and ranging radios. Another embodiment may utilize sonic or acoustic waves to determine proximity between the excavating machine 100 and the first and second hoppers 170, 172. Accordingly, in these embodiments, the first and second hopper data may be visual or acoustic data.

In another embodiment, the guidance system 200 and the dispensing process 300 can determine which of the first and second hoppers 170, 172 is selected based on the type or grade of the material being removed from the pit wall 108. To make this determination, the dispensing process 300 can, in a receive material information step 330, obtain excavation site data 292 from the excavation maps 294 associated with excavation base station 290. In a specific embodiment, the excavation site data 292 can be received or input into the guidance system 200 by the machine receiver/transmitter 212 via the excavation network 202. The dispensing process 300 can also receive the machine position data 320 determined by the machine position sensor 214. In a material determination step 332, the dispensing process 300 can compare and assess the excavation site data 292 and the machine position data 320 to determine the grade, type, or granularity size of material likely to be excavated by the excavating machine 100 based on its present position. For example, the excavating machine 100 may be proximate to a vein of ore or the like, or may be proximate to a substantial amount of overburden, such that the material determination step 332 can determine the composition of the material removed with a sufficient degree of confidence. In another embodiment, rather than receiving excavation site data 292, the digging tool 110 of the excavating machine 100 can be configured with a material sensor 216 to determine the volume, composition, or quality of the excavated material removed by the digging tool 110. Suitable sensors include weight sensors, X-ray sensors, electromagnetic sensors, audio wave or sonic sensors, laser scanners and the like that can determine the composition and quality of the material in the digging tool 110. This information can be transmitted as material data 336 transmitted from the machine receiver/transmitter 212 and communicated through the excavation network 202.

In the present embodiment, the first hopper 170 and the second hopper 172 can be configured to process different types of material, for example, by including different grinding mechanisms to process harder materials such as coal or ore verses softer materials such as overburden. In addition, the first and second hoppers 170, 172 can be configured to treat the material differently, for example, by including different sprays, additives, or the like. To select a suitable hopper, the first hopper data 248 and the second hopper data 268 received in the receiving hopper data step 304 can reflect hopper configuration data regarding the first and second hoppers 170, 172. The dispensing process 300 directs the hopper configuration data and the results of the material determination step 332 to a data comparison step 334 that compares the data to determine whether the material is better suited for processing through the first or second hoppers 170, 172. The results of the data comparison step 334 are sent to the hopper selection step 312 to determine the selected hopper 314. Additionally or alternatively, the data comparison step 334 can receive and utilize the material information 336 obtained from the material sensor 216 on the machine 100 to compare and select the first or second hopper 170, 172 based on their configuration.

Figure 5:
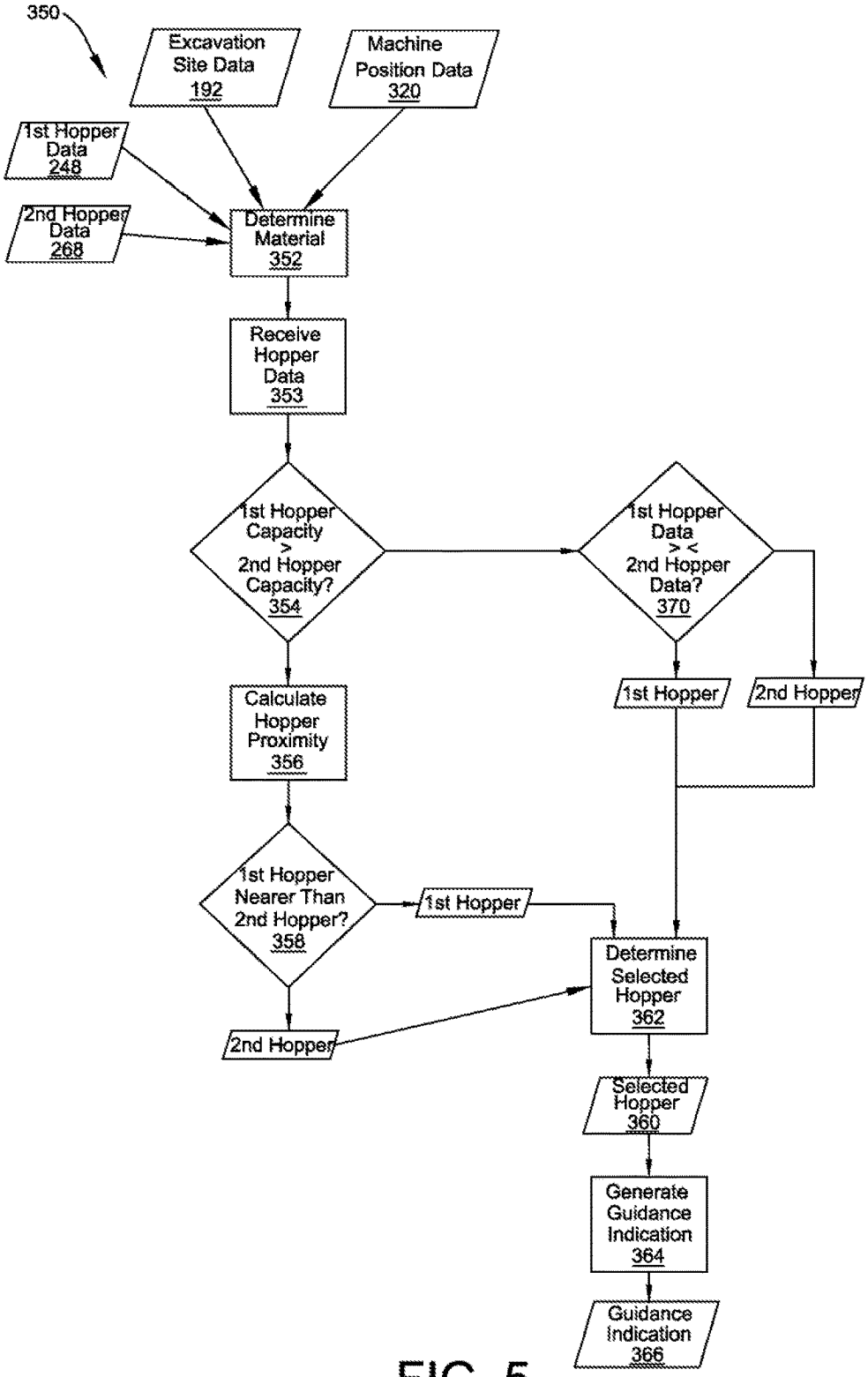
FIG. 5 is a logic diagram or flowchart representing a possible process for assisting the excavation process by determining a target digging location based on data regarding the first hopper and the second hopper of the IPCC.

In another aspect, the guidance system 200 can generate and provide guidance on where the excavating machine 100 should dig based on the data associated with the first and second hoppers 170, 172 of the IPCC 102. Referring to FIG. 5, in this embodiment, the guidance system 200 can execute a digging process 350 that can initially receive the excavation site data 292 from the excavation maps 294 and machine position data 320 reflecting the position of the excavating machine 100 at the excavation site 104. The digging process 350 can execute a material determination step 352 based on the data to determine the types or grades of material proximate to the excavating machine 100. For example, the material determination step 352 informs the guidance system 200 of what types of material such as coal, ore, or overburden are at different locations about the excavation site 104. In a data reception step 353, the digging process 350 also receives first hopper data 248 and second hopper data 268 associated with the first and second hoppers 170, 172 on the IPCC 102, which may include hopper capacity data, hopper location data, and/or hopper configuration data regarding the first and second hoppers 170, 172. In a capacity comparison step 354, the digging process 350 compares the first hopper capacity with the second hopper capacity to determine which of the first and second hoppers 170, 172 is able to receive material.

If the both the first and second hoppers 170, 172 can receive material, the digging process 350 proceeds to a proximity calculation step 356 to calculate the relative proximity or distance between the digging tool 110 of the excavating machine 100 and the first and second hoppers 170, 172. This may reflect the angular swing distance between the digging tool 110 and the first and second hoppers 170, 172. A subsequent determination step 358 determines which of the first and second hoppers 170, 172 is nearest and, as a result, can determine a selected hopper 360 in a subsequent hopper selection step 362. Because the selected hopper 360 may be configured for a particular type of material, the digging process 350 can perform a guidance generation step 364 that compares the selected hopper 360 with the results of the material determination step 352. The guidance generation step 364 can generate a guidance indication in the form of a target digging location 366 for excavating material suitable for the selected hopper 360. Accordingly, the target digging location 366 can direct the excavating machine 100 to swing or otherwise move to a location in accordance with the capacity and configuration of the selected hopper 360. In an embodiment, the target digging location 366 can be displayed on the display screen 222 of the electronic user interface 220 as coordinates, overlays, or the like while in other embodiments, the machine controller 210 can utilize the target digging location 366 to automatically direct the excavating machine to excavate at the desired location.

If, however, the digging process 350 during the capacity comparison step 354 is indeterminate, the digging process 350 can proceed to a refinement step 370 which attempts to refine the comparison between the first hopper 170 and the second hopper 172 based on, for example, hopper capacity or hopper location. In particular, the refinement step 370 can compare the first hopper data 248 and the second hopper data 268 to determine which is more suitable for presently receiving material. The results of the refinement step 370 are directed to hopper selection step 362 to determine the selected hopper 360 from between the first hopper 170 and the second hopper 172. As before, the selected hopper 360 and the results of the material determination step 352 can be processed by the guidance generation step 364 to determine a target digging location 366 for digging.

Accordingly, the foregoing disclosure provides operator assistance or guidance for excavating material with a dual-hopper IPCC through the interaction of communication devices, sensors and logic deceives associated with the equipment at the excavation site. The guidance system enables efficient use of the first hopper and the second hopper to maximize output of the excavation operation.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. An excavating machine for excavation at an excavation site in cooperation with a first hopper and a second hopper for receiving material, the excavating machine comprising:

a digging tool configured to excavate and dispense material;

a machine receiver configured to receive first hopper data associated with the first hopper and second hopper data associated with the second hopper; and a guidance system in communication with the machine receiver configured to process the first hopper data and the second hopper data to determine a selected hopper between the first hopper and the second hopper, and generating a guidance indication reflecting the selected hopper.

2. The excavating machine of claim 1, wherein the first hopper data and the second hopper data are selected from the group comprising hopper location data, hopper capacity data, and hopper configuration data.

3. The excavating machine of claim 2, further comprising a machine position sensor sensing and communicating machine position data to the guidance system.

4. The excavating machine of claim 3, wherein the guidance system compares the machine position data and the hopper location data from the first hopper and the second hopper to determine the selected hopper.

5. The excavating machine of claim 4, wherein the machine receiver is a receiver/transmitter adapted to receive communication signals representing the first hopper data and the second hopper data.

6. The excavating machine of claim 2, wherein the guidance system determines the selected hopper by comparing the hopper configuration data with material data obtained from a material sensor disposed on the excavating machine.

7. The excavating machine of claim 1, wherein the machine receiver is an optical sensor and the first hopper data and the second hopper data are optical data associated with the first hopper and the second hopper respectively.

8. The excavating machine of claim 2, wherein the guidance system determines the selected hopper by comparing the hopper capacity data associated with the first hopper and the second hopper.

9. The excavating machine of claim 1, further comprising an electronic user interface to communicate the guidance indication reflecting the selected hopper that is generated by the guidance system.

10. The excavating machine of claim 2, wherein the machine receiver is a receiver/transmitter adapted to communicate with an excavation network to receive excavation site data reflecting material information; and the guidance system compares the excavation site data with the hopper configuration data associated with the first hopper and the second hopper to determine the selected hopper.

11. The excavating machine of claim 10, further comprising an electronic user interface to communicate a target digging location indicating where excavate material from at the excavation site based on selected hopper.

12. A method of assisting excavation at an excavation site comprising:

providing a first hopper and a second hopper for receiving material at an excavation site;

receiving first hopper data associated with the first hopper;

receiving second hopper data associated with the second hopper;

comparing the first hopper data and the second hopper data to determine a selected hopper from the first hopper and the second hopper for depositing excavated material;

generating a guidance indication reflecting the selected hopper; and displaying the guidance indication to an operator of an excavating machine operating in cooperation with the first hopper and the second hopper.

13. The method of claim 12, wherein the first hopper data and the second hopper data are selected from the group comprising hopper location data, hopper capacity data, and hopper configuration data.

14. The method of claim 13, further comprising receiving machine position data and determining the selected hopper based on proximity by comparing the machine position data with the hopper location data associated with the first hopper and the second hopper.

15. The method of claim 14, wherein the hopper location data is visual data received by an optical sensor disposed on the excavating machine.

16. The method of claim 13, wherein the step of determining the selected hopper compares the hopper capacity data associated with the first hopper and with the second hopper.

17. The method of claim 13, further comprising receiving excavation site data associated with the excavation site; comparing the excavation site data with the hopper configuration data associated with the first hopper and the second hopper during the step of determining the selected hopper; and generating a target digging location indicating where to excavate material at the excavation site based on the selected hopper.

18. A guidance system for assisting excavation at an excavation site utilizing a first hopper and a second hopper configured to receive material, the guidance system comprising:

a machine controller operatively associated with an excavating machine, the machine controller communicating with a machine receiver disposed on the excavating machine;

a first hopper transmitter operatively associated with a first hopper and communicating first hopper data associated with the first hopper; and a second hopper transmitter operatively associated with the second hopper and communicating second hopper data associated with the second hopper;

wherein the guidance system determines a selected hopper for dispensing material into based on comparison of the first hopper data and the second hopper data.

19. The guidance system of claim 18, wherein the first hopper data and the second hopper data are selected from the group comprising hopper location data, hopper capacity data, and hopper configuration data.

20. The guidance system of claim 19, further comprising an electronic user interface configured to communicate a guidance indication generated by the guidance system that reflects the selected hopper.

* * * * *